US010378543B2

(12) United States Patent
Buchholz et al.

(10) Patent No.: US 10,378,543 B2
(45) Date of Patent: Aug. 13, 2019

(54) IMPELLER, IN PARTICULAR FOR A SIDE CHANNEL MACHINE

(71) Applicant: Gebr. Becker GmbH, Wuppertal (DE)

(72) Inventors: Lars Buchholz, Wetter (DE); Antje Gennat, Wuppertal (DE); Ulli Kriebel, Solingen (DE); Henryk Waniek, Solingen (DE); Achim Von Kathen, Wuppertal (DE)

(73) Assignee: Gebr. Becker GbmH, Wuppertal (DE)

( * ) Notice: Subject to any disclaimer, the term of this patent is extended or adjusted under 35 U.S.C. 154(b) by 447 days.

(21) Appl. No.: 15/305,739

(22) PCT Filed: Mar. 19, 2015

(86) PCT No.: PCT/EP2015/055775
§ 371 (c)(1),
(2) Date: Oct. 21, 2016

(87) PCT Pub. No.: WO2015/169496
PCT Pub. Date: Nov. 12, 2015

(65) Prior Publication Data

US 2017/0051753 A1 Feb. 23, 2017

(30) Foreign Application Priority Data

May 8, 2014 (DE) ..... 10 2014 106 440

(51) Int. Cl.
*F04D 5/00* (2006.01)
*F04D 23/00* (2006.01)
(Continued)

(52) U.S. Cl.
CPC ..... *F04D 5/002* (2013.01); *F04D 23/008* (2013.01); *F04D 29/188* (2013.01); *F04D 29/28* (2013.01)

(58) Field of Classification Search
CPC ..... F04D 5/002; F04D 23/008; F04D 29/188; F04D 29/28
See application file for complete search history.

(56) References Cited

U.S. PATENT DOCUMENTS 5,407,318 A 4/1995 Ito et al.
5,628,615 A 5/1997 Asabuki et al.
(Continued)

FOREIGN PATENT DOCUMENTS

DE 10 2005 008 388 A1 8/2006

OTHER PUBLICATIONS

International Search Report of PCT/EP2015/055775, dated Jul. 1, 2015.

*Primary Examiner* — Woody A Lee, Jr.
(74) *Attorney, Agent, or Firm* — Collard & Roe, P.C.

(57) ABSTRACT

The invention relates to an impeller (1), in particular for a side channel machine, comprising blades (5) arranged distributed in the circumferential direction and formed in each case by a blade wall (6), which blades form open blade chambers (4) in a plan view onto the impeller (1), wherein a blade wall (6) in the plan view starts at a first radius dimension ($r_1$) related to the geometrical impeller rotation axis (x), which first radius dimension ($r_1$) corresponds to half or more than half of a second radius dimension ($r_2$), which second radius dimension ($r_2$) defines a circumferential rim edge (9) of the impeller (1), and wherein the radius dimension ($r_1$) defines a radially inner boundary wall (7) of the blade chamber (4), wherein furthermore a blade wall (6) comprises an exposed upper terminating edge, which runs correspondingly radially on the inside into the inner boundary wall (7) and ends radially on the outside in plan view, wherein an imaginary connecting line (V) can be drawn between a run-in point of the terminating edge (12) into the inner boundary wall (7) and a radially outer end of the
(Continued)

terminating edge (12) and the terminating edge runs normal to the connecting line (V) with a different offset dimension, wherein a greatest offset dimension results. For the advantageous development, in particular with regard to improved efficiency, it is proposed that the greatest offset dimension corresponds to 0.1 times or more the difference between the second ($r_2$) and the first radius dimension ($r_1$).

18 Claims, 7 Drawing Sheets

(51) Int. Cl.
*F04D 29/18* (2006.01)
*F04D 29/28* (2006.01)

(56) References Cited

U.S. PATENT DOCUMENTS

| | | | | |
|---|---|---|---|---|
| 6,213,734 | B1 * | 4/2001 | Imhof | F02M 37/048 415/10 |
| 9,599,126 | B1 * | 3/2017 | Sagher | F04D 29/666 |
| 2003/0026686 | A1 | 2/2003 | Kusagaya et al. | |
| 2003/0118438 | A1 | 6/2003 | Usui et al. | |
| 2003/0118439 | A1 * | 6/2003 | Usui | F04D 5/002 415/55.1 |
| 2004/0071543 | A1 * | 4/2004 | Ikeya | F04D 5/002 415/55.1 |
| 2005/0226715 | A1 | 10/2005 | Inuzuka et al. | |
| 2006/0104804 | A1 * | 5/2006 | Yu | F04D 5/002 415/55.1 |
| 2007/0065313 | A1 * | 3/2007 | Deichmann | F02M 37/048 417/423.1 |

* cited by examiner

IMPELLER, IN PARTICULAR FOR A SIDE CHANNEL MACHINE

CROSS REFERENCE TO RELATED APPLICATIONS

This application is the National Stage of PCT/EP2015/055775 filed on Mar. 19, 2015, which claims priority under 35 U.S.C. § 119 of German Application No. 10 2014 106 440.2 filed on May 8, 2014, the disclosure of which is incorporated by reference. The international application under PCT article 21(2) was not published in English.

The invention relates to an impeller, in particular for a side channel machine such as a side channel compressor or a side channel vacuum pump, comprising blades arranged distributed in the circumferential direction and formed in each case by a blade wall, which blades form open blade chambers in a plan view onto the impeller, in which plan view a geometrical impeller-impeller rotation axis is depicted in a point-like manner, wherein a blade wall in the plan view starts at a first radius dimension related to the geometrical impeller-impeller rotation axis, which first radius dimension corresponds to half or more than half of a second radius dimension, which second radius dimension defines a circumferential rim edge of the impeller, and wherein the first radius dimension defines a radially inner boundary wall of the blade chamber, wherein furthermore a blade wall comprises an exposed upper terminating edge, which runs correspondingly radially on the inside into the inner boundary wall and ends radially on the outside in plan view, wherein an imaginary connecting line can be drawn between a run-in point of the terminating edge into the inner boundary wall and the radially outer end and the terminating edge runs normal to the connecting line with a different offset dimension, wherein a greatest offset dimension results.

An impeller of the type mentioned is known for example from DE 102005008388 A1.

The problem underlying the invention is to develop further an impeller of the mentioned type in an advantageous way, especially with regard to improved efficiency.

A possible solution to the problem is provided according to a first inventive idea with an impeller with which attention is focused on the fact that the greatest offset dimension corresponds to 0.1 times or more the difference between the first and second radius dimension. As a result of the terminating edge of the blade running in the course of its extension between the first and second radius dimension with the offset dimension, increased efficiency and/or an improvement in the radial speed component can be achieved compared to impeller embodiments with terminating edges running in a straight line or running offset less than the 0.1 times.

Such impellers find widespread use in side channel compressors and side channel vacuum pumps, which enable a broad spectrum of industrial applications, e.g. in printing, packaging, electronics, environmental and medical technology etc. These flow machines comprise at least one annular working chamber with an essentially circular cross-section, in which an impeller with blading, i.e. blades and blade chambers lying between the latter, is accommodated rotatable in the impeller circumferential direction. The unfilled cross-section of the working chamber adjacent to the blading, optionally on both sides of the impeller, forms in each case a side channel, which is interrupted at the circumference by the so-called interrupter. An inlet for a fluid to be condensed (for example gas or liquid) is located behind in the interrupter in the rotary or rotation direction of the impeller, whilst an outlet is located lying before the interrupter in the rotation direction. As a result of the rotation of the impeller, the fluid flows through the inlet into the side channel and is carried along by the blades of the impeller. In its flow spaces, the fluid is also pushed outwards on account of the centrifugal force and is condensed there. The following flowing fluid pushes the condensed fluid out of the blades into the side channel, where it is conveyed radially inwards and enters again into the impeller blading. The fluid passes from the side channel at the impeller end face through a radially inner chamber inlet region into the flow space bordered by the blade chambers and, after flowing through the blade chambers, back through a radially outer chamber region into the side channel. The so-called circulation is repeated several times, so that the fluid can be condensed in a number of stages up to the discharge.

The greatest offset dimension preferably corresponds to 0.1 times up to 0.6 times, if appropriate even more, the difference between the first and second radius dimension. The greatest offset dimension can thus also correspond to approximately a third of the difference between the first and second radius dimension.

The terminating edge of a blade wall also preferably extends radially on the outside essentially in the direction of the impeller-impeller rotation axis. Accordingly, a radially outer edge thus results, which extends essentially normal to the terminating edge of the blade wall. The rim edge can for example run in a range of +/−5° normal to the terminating edge. Furthermore, this radially outer edge defines the dimension of the greater radius of the impeller, at all events in the case an embodiment radially open on the outside, wherein the blade chambers are open radially outwards. In this case, the blades end exposed radially outwards.

The blade wall can also transform radially on the outside into a circumferential terminating wall. The formed blade chamber is bounded, in relation to a cross-section, by the chamber floor and the inner and outer boundary wall or blade walls following one another in the direction of rotation and is constituted open preferably only in the region of an area given by the terminating edges of the blade walls. In a preferred embodiment, an outer edge of the radially outer terminating wall defines the second radius dimension.

The imaginary connecting line between the run-in point of the terminating edge into the inner boundary wall and the radially outer end can run, in respect of the plan view, in such a way that it is parallel to a radial line proceeding from the geometrical impeller rotation axis. Especially when a radial line passing through the inner run-in point or the radially outer end of the boundary wall is observed in plan view, the connecting line can form an acute angle of for example 0.05 to 15° with the radial line. It is preferred that the connecting line in the extension in the direction of the geometrical impeller rotation axis runs at a distance from the geometrical impeller rotation axis.

The perpendicular spacing dimension of the connecting line from the geometrical impeller rotation axis is given by the length of a vertical to the connecting line, which vertical intersects the geometrical impeller rotation axis. The vertical spacing dimension can lie in the range from −40% to +40% of the outer radius dimension. In a restricted consideration, the spacing dimension can lie in the range from −40% to +40% of the radial difference between the inner and outer radius.

There can be both a "lead" of the radially outer end of the terminating wall with respect to the run-in point into the inner boundary wall as well as a "lag". Viewed from the mentioned run-in point radially outwards, the radially outer end of the terminating wall can, with a given direction of rotation, thus be constituted leading in the direction of rotation and also lagging against the direction of rotation.

The radially outer end of the terminating edge can form an acute angle of up to 90° with the connecting line or the radial line (proceeding from the rotation axis) passing through the radially outer end. An acute angle of 50 to 75°, for example 70°, is preferred. The acute angle relates to a run-in section of the terminating edge into the outer wall. The radially outer end of the terminating edge preferably runs tangentially into a circular line connecting the radially outer ends of all the terminating edges, or, as further preferred, into the radially outer terminating wall, so that the acute angle described above is adjusted between a tangent passing through the intersecting point of the terminating edge and an idealised, i.e. averaged, line of the terminating wall indicated there, and the connecting line.

In the case of a straight course of the terminating wall in the run-in section, the acute angle relates to the angle between the straight line producing the straight course and the connecting line.

With regard to the horizontal section, the terminating edge can at least partially comprise straight segments. One straight segment can be provided, but moreover also a plurality of straight segments arranged behind one another, thus for example two, three, four or even ten straight segments. These straight segments extend over the shortest distance between a respective straight segment start and a straight segment end. Such a straight segment can continue following a curved segment. A region between two straight segments can be formed by a curved region.

With regard to the horizontal section, in the case of two or more adjacent straight segments, the latter can be arranged at an angle with respect to one another (irrespective of any curved section that may be located in between). An obtuse angle of more than 90° up to 179°, thus for example 150 or 160°, is preferred here.

The terminating edge can also run continuously curved between inner and outer radius. Preferably, there is an interruption-free curvature here between the inner and outer radius, which curvature comprises a plurality, for example two, three, four or ten curved segments arranged one after the other. One or more curvature segments can by themselves run curved in the form of a circle and correspondingly following a radius. In the case of a plurality or all of the curvature segments following a radius, the latter can have different radii, wherein a plurality of curvature segments can also have the same radii in the case of a plurality of curvature segments.

Preferably, the terminating edge essentially follows a radius line, so that a constant radius, possibly having a divergence of for example +/−5% of the respective radius dimension, ensues over the extension length of the terminating edge.

In the case of an embodiment of the terminating edge along a radius line, the radius of the terminating edge is preferably measured from a circle centre-point which, related to a distance from the geometrical impeller rotation axis, lies between the first and the second radius dimension. The circle centre-point preferably lies inside a blade chamber, and moreover preferably in a blade chamber following, in the circumferential direction, the blade wall comprising the terminating edge. The circle centre-point can thus lie in the blade chamber lying upstream as viewed in the direction of rotation of the impeller. The circle centre-point also preferably lies on or adjacent to a radius line of the geometrical impeller rotation axis, which radius line runs midway between the first and the second radius dimension.

In the case of a terminating edge running curved—in the mentioned plan view—and also in the case of a terminating edge which at least partially comprises straight segments, the end segments of the terminating edge facing the first and the second radius dimension can run curved. The radius of these end segments of the terminating edge running preferably tangentially into the radially inner boundary wall and, as the case may be, into the radially outer boundary wall and also preferably running in the form of a circular segment can be selected smaller or also larger than a radius dimension of for example a terminating edge following a radius line. The radius of the outer end regions of the terminating edge preferably corresponds to 0.5 to 0.9 times the radius of the terminating edge between the end regions.

The blade wall can increase in size with regard to a wall thickness proceeding from the terminating edge in the direction of the geometrical impeller rotation axis or in the direction of a chamber floor. Thus, the wall thickness of the blade wall close to or at the transition to the chamber floor can correspond to 2 to 4 times, preferably 3 times the wall thickness in the region of the terminating edge.

The increase in the wall thickness—related to the circumferential direction—may be different. Thus, related to a cross-section through the blade wall, in the circumferential direction of the impeller, radially between the inner run-in point and the outer end of the blade wall, for example the midpoint between the first radius dimension and the second radius dimension, the blade wall edges can form different acute angles with a straight line running parallel to the geometrical impeller rotation axis. Related to the straight line described above, the angle of a blade wall edge can be 1 to 10°, whilst the angle of the opposite blade wall edge with respect to straight line 11 amounts to 30°.

The acute angle of the blade wall edge opposite to the direction of rotation is preferably greater than the acute angle of the blade wall edge in the direction of rotation. There can be a ratio between these different angles of 1:3 to 1:10.

The blade wall can run in a convex manner viewed in the direction of rotation. The blade wall running in a curved manner in the horizontal section opens correspondingly in the direction of rotation.

The chamber floor, in a cross-section, can run in a circular or elliptical shape in the connecting line or parallel thereto. In the case of a circular course, the circular shape preferably has a constant radius in cross-section over the extension length of the chamber floor. A curvature with different radii can also be provided over the extension length.

In any event, the chamber floor can run radially on the inside, for example following a circular or elliptical line, into an upper edge of the inner terminating wall.

An embodiment of the blade chamber in the shape of a semicircular disc can arise in a cross-section in the connecting line or parallel thereto.

The greatest depth of the chamber floor preferably corresponds to 0.25 to 0.75 times the radius difference between the inner and outer radius. In an embodiment, the depth corresponds to half the radius difference. The depth is measured here proceeding from a (optionally greatest) height of the terminating edge in the direction of the rotation axis.

As a result of the preferred curvature of the blades orientated overall at least approximately radially, the radial speed is increased apart from the peripheral speed when there is a pressure buildup during operation, in contrast with the known solutions. The pressure buildup is improved. In addition, the proposed solution offers the possibility of an impeller that is radially closed to the exterior, as a result of which a two-stage operation can be achieved with only one impeller.

The ranges or value ranges or multiple ranges stated above and below also include, in terms of the disclosure, all intermediate values, in particular in 1/10 steps of the given dimension, also therefore dimensionless if applicable. For example, the indication 0.1 to 0.5 times also includes the disclosure of 0.11 to 0.5 times, 0.1 to 0.49 times, 0.12 to 0.5 times, 0.12 to 0.9 times, 0.12 to 0.48 times, 0.1 to 0.48 times etc., the disclosure of 15 to 40% also includes the disclosure of 15.1 to 40%, 15 to 39.9%, 15.1 to 39.9%, 15.2 to 40%, 15.2 to 39.9%, 15.2 to 39.8%, 15 to 39.8% etc., the disclosure of 60 to 89° also includes the disclosure of 60.1° to 89°, 60° to 88.9°, 60.2° to 89°, 60.2° to 88.8°, 60.2° to 88.8°, 60° to 88.8° etc. This disclosure can serve on the one hand as a limitation of a stated range limit from below and/or above, but alternatively or in addition for the disclosure of one or more singular values from a range indicated in each case.

The invention is explained below with the aid of the appended drawing, which however solely represents examples of embodiment. A part which is explained only in relation to one of the examples of embodiment and in a further example of embodiment is not (directly) replaced by another part on account of the particular feature highlighted there is therefore also described for this further example of embodiment as a part that may in any case be present:

Figure 1:
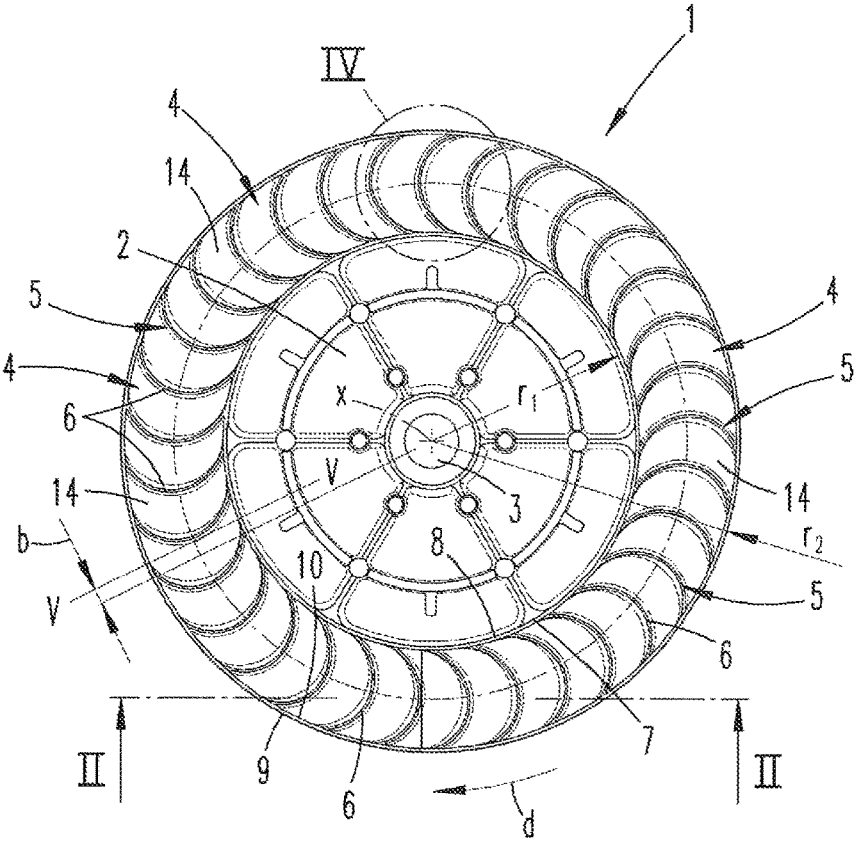
FIG. 1 shows an impeller in plan view.

With regard to FIG. 1, an impeller 1, in particular a side channel machine, such as a side channel compressor or a side channel vacuum pump, is first represented and described.

Impeller 1 comprises a hub 2 lying in the centre with a through-hole 3, which serves to fix impeller 1 to a drive shaft (not represented) of a side channel machine.

Figure 2:
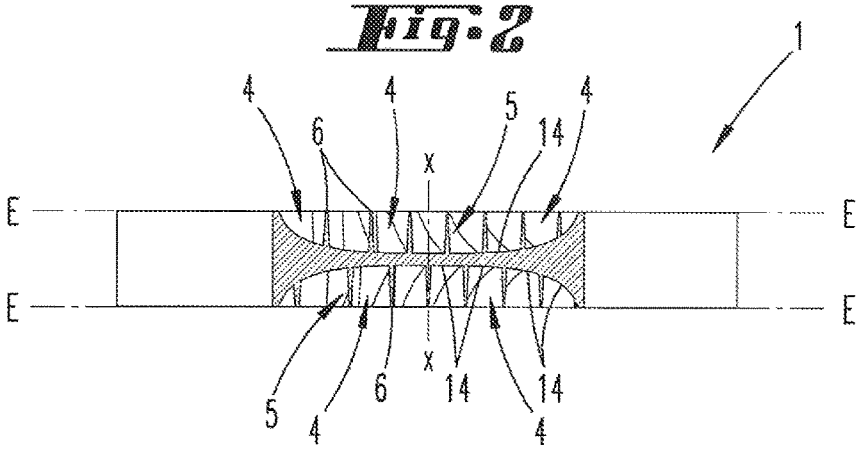
FIG. 2 shows the cross-section according to line II-II in FIG. 1.
Figure 3:
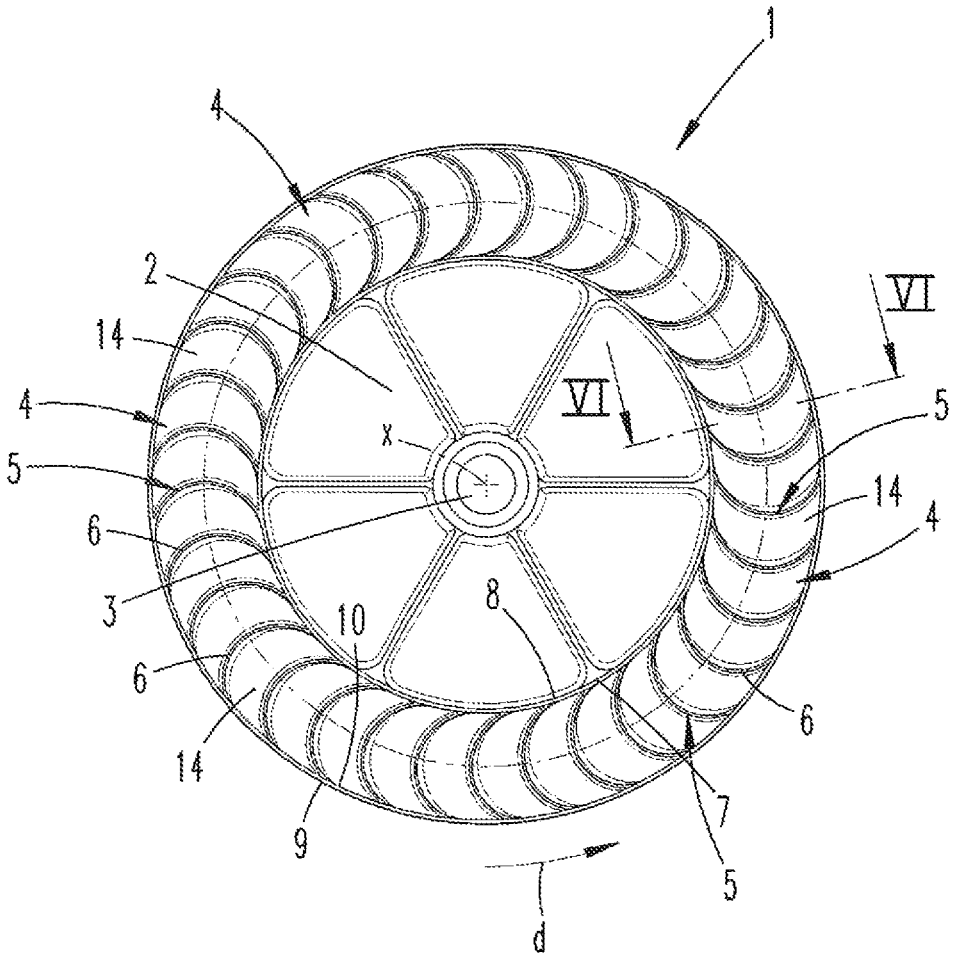
FIG. 3 shows the view of the impeller from beneath.

Impeller 1 comprises, distributed uniformly in the circumferential direction, blade chambers 4 open towards an upper opening plane E with reference to FIG. 2. Said blade chambers, viewed in the circumferential direction, are laterally bordered by blade walls 6 forming blades 5.

Blades 5 and also blade chambers 4 are formed in a radially outer region of impeller 1. Preferably, and in the example of embodiment, blades 5 form, possibly with the exception of a terminating wall, as explained below, the radially outer boundary of impeller 1.

The embodiments represented in particular in FIGS. 1 to 9 relate to an impeller 1 for constituting a two-stage side channel machine. With reference to a central plane running parallel to opening plane E, which central plane intersects geometrical impeller rotation axis x at right angles, blades 5 are accordingly constituted for the formation of blade chambers 4 on both sides of the central plane.

Blade chambers 4 are limited radially on the inside by inner circumferential boundary wall 7. Related to a cross-section, the latter ends with the formation of a boundary wall edge 8 in opening plane E.

A terminating wall 10 is formed circumferentially along circumferential rim edge 9, preferably also forming the latter. According to FIG. 6 for example, said terminating wall also extends into opening plane E with the formation of a terminating wall edge 11 running in opening plane E.

Inner boundary wall 7 runs along a first, inner radius dimension $r_1$. This radius dimension $r_1$ preferably relates to a radial inner edge of boundary wall 7 and, in the represented examples of embodiment, preferably corresponds to two thirds of a radius dimension $r_2$ of a radially outer edge of terminating wall 10.

Blade walls 6 extend between radially inner boundary wall 7 and radially outer terminating wall 10, said blade walls each running in a convex form viewed in direction of rotation d (viewed from a preceding blade wall onto the following blade wall in the direction of rotation).

Thirty to forty five blades 5 can for example be provided distributed uniformly over the circumference, thus for example thirty five blades 5.

Each blade wall 6 comprises an exposed upper terminating edge 12 which extends in opening plane E. This terminating edge 12 runs radially on the inside into the inner boundary wall, in particular into boundary wall edge 8, and ends radially on the outside in circumferential rim edge 9, in particular in terminating wall edge 11 of terminating wall 10.

Figure 4:
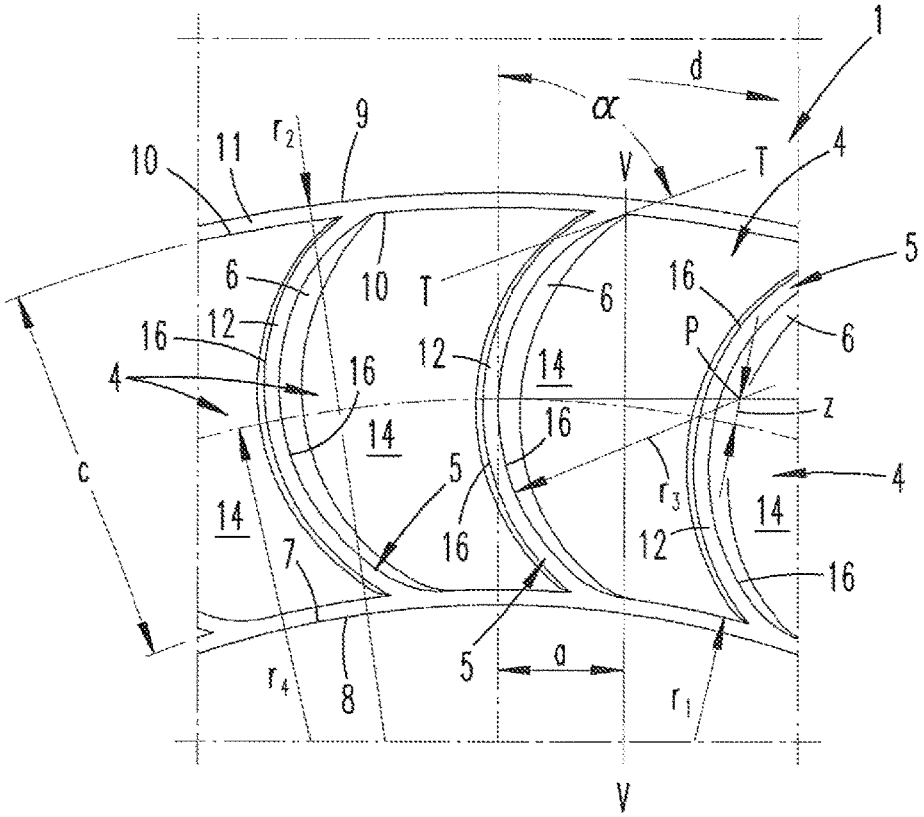
FIG. 4 shows the detail enlargement of region IV in FIG. 1, relating to a first embodiment of a blade wall.

An imaginary connecting line V can be drawn between the radially inner run-in point of blade wall 6 into boundary wall 7 and the radially outer end of blade wall 6, for example the end of blade wall 6 running into terminating wall 10 (see for example FIG. 4).

Connecting line V runs here in opening plane E or in a plane parallel thereto.

In particular, terminating edge 12 of each blade wall 6 runs normal to connecting line V with a different offset dimension a. Greatest offset dimension a preferably arises midway between radially inner boundary wall 7 and radially outer terminating wall 10 or circumferential rim edge 9.

In the examples of embodiment represented, offset dimension a roughly corresponds to a third of difference dimension c between second radius dimension $r_2$ and first radius dimension $r_1$.

Blade walls 6 of the embodiment represented in FIGS. 1 to 4 are constituted such that terminating edges 12 essentially follow a radius line. Radius $r_3$—related to the inner rim edge of the terminating rim edge facing the radius centre-point—is measured from circle centre-point P, which lies in a blade chamber 4 located upstream in direction of rotation d or in blade wall 6 separating preceding blade chamber 4 from described blade chamber 4.

Furthermore, with reference in particular to the rim edge of terminating edge 12 facing circle centre-point P in the horizontal section according to FIG. 4, the ends of terminating edge 12 preferably run tangentially into facing boundary wall 7 or terminating wall 10. For this purpose, the end sections of terminating edge 12 can be provided with a changed radius with respect to radius $r_3$, in particular with a smaller radius with respect to the latter, the circle centre-point whereof lies in blade chamber 4 bordered by described blade wall 6.

Circle centre-point P of radius $r_3$ can lie on radius line $r_4$ bisecting blade chamber 4 in the radial direction between boundary wall 7 and terminating wall 10.

In one embodiment, circle centre-point P is offset radially outwards in the radial direction towards geometrical impeller rotation axis x by dimension z with respect to radius $r_4$. Dimension z roughly corresponds to a tenth up to a fifth of difference dimension c.

Figure 5:
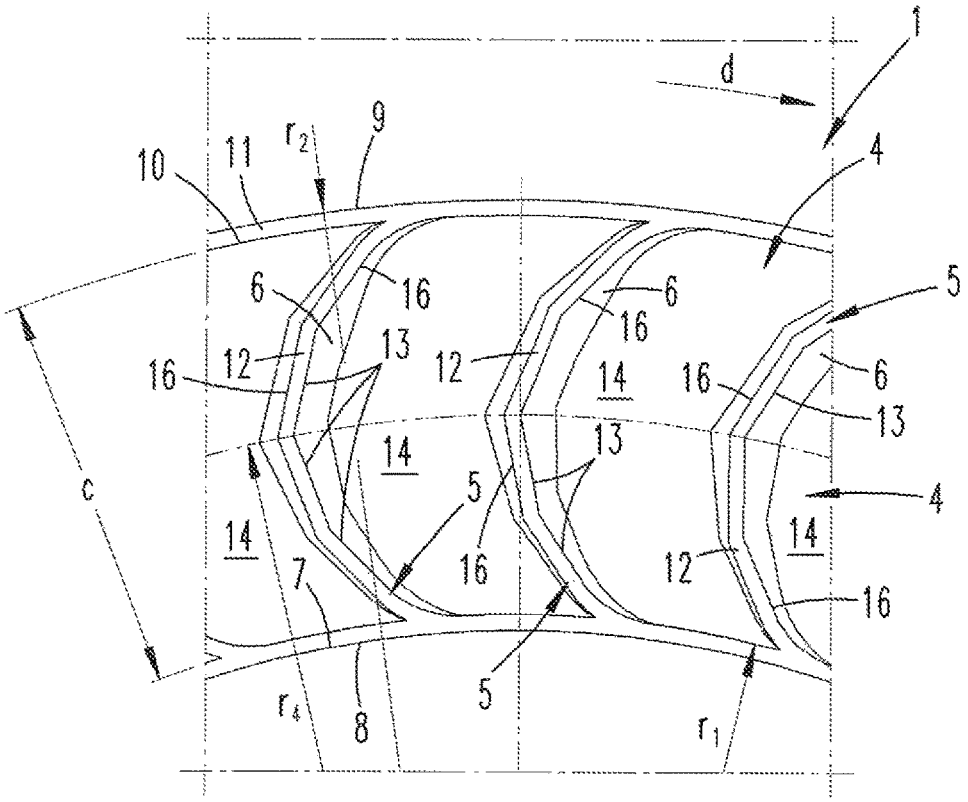
FIG. 5 shows a representation corresponding to FIG. 4, relating to an alternative embodiment of the blade wall.

Blade wall 6, in particular terminating edge 12, can also at least partially comprise straight segments 13, which in the horizontal section according to FIG. 5 each assume different acute angles with respect to a radial line. Straight segments 13 are disposed as a whole such that an overall convex course arises as viewed in direction of rotation d of impeller 1.

At each end, a terminating edge 12 thus constituted can run with a radius line tangentially into boundary wall 7 and into circumferential rim edge 9 or into terminating wall 10.

The radially outer end of terminating edge 12, optionally a tangent T passing through the point of intersection of terminating edge 12 and terminating wall 10, can preferably form with connecting line V an acute angle $\alpha$ of approx. 70° (see FIG. 4). The radially outer end of terminating edge 12, in a planar embodiment of terminating edge 12, as is preferably and also given for the examples of embodiment, is given by a curvature rim line of terminating edge 12.

Connecting line V runs in the extension in the direction of geometrical impeller rotation axis x with a spacing b (see for example FIG. 1) with respect to geometrical impeller rotation axis x, which perpendicular spacing dimension b roughly corresponds to a twentieth up to a fifteenth of outer radius r2.

Figure 6:
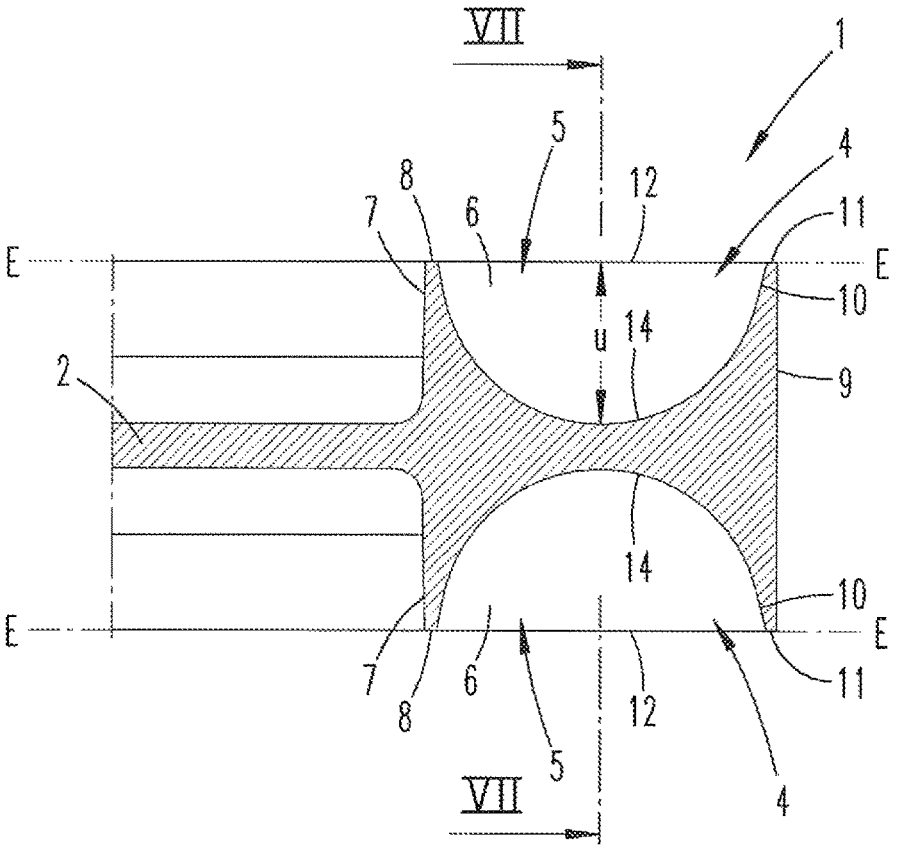
FIG. 6 shows the cross-section according to line VI-VI in FIG. 3.

Chamber floor 14 arising between two blade walls 6 arranged one behind the other viewed in direction of rotation a and inner boundary wall 7 and, in an embodiment, also radially outer terminating wall 10, runs in the form of a circle segment in a cross-section, in which cross-section impeller rotation axis x is represented as a line (see FIG. 6). The circle centre-point of the circular line describing chamber floor 14 preferably lies within opening plane E.

The circular line describing chamber floor 14 runs in particular radially on the inside into boundary rim edge 8.

In an embodiment with blade chambers 4 closed radially on the outside according to the representations in FIGS. 1 to 9, this circular line also runs preferably radially outwards into terminating rim edge 11 extending in opening plane E.

Figure 9:
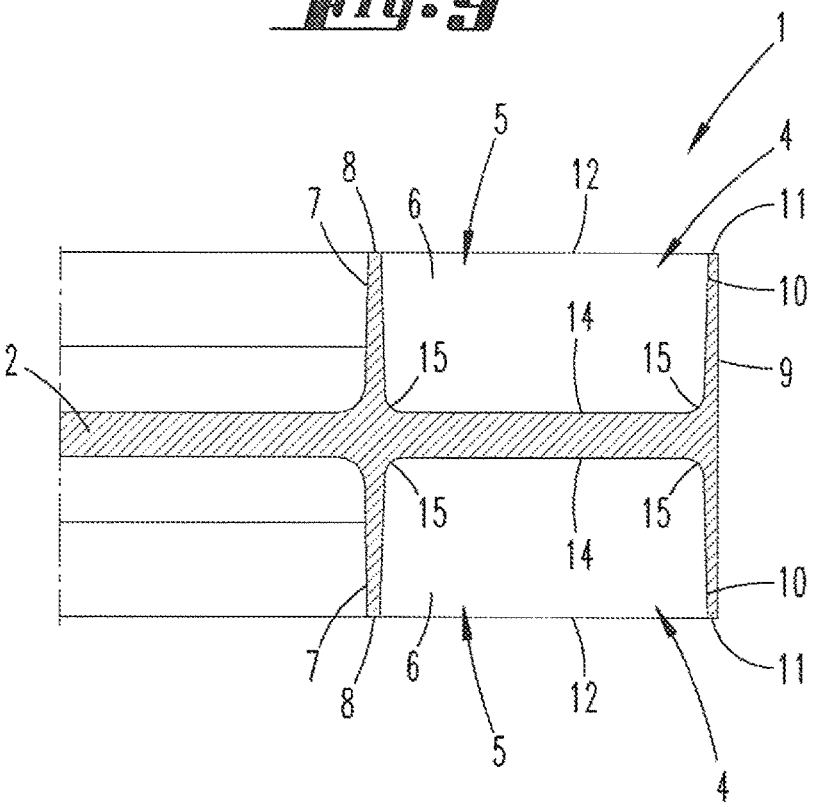
FIG. 9 shows a representation corresponding to FIG. 6 relating to a further embodiment.

Alternatively, chamber floor 14 according to the representation in FIG. 9 can also be constituted in the form of a half rectangle with rounded corners 15. Chamber floor 14 is preferably constituted here running parallel to opening plane E. Wall sections extend from the regions of rounded corners 15 facing away from chamber floor 14 into opening plane E, which wall sections run parallel to impeller rotation axis x or form an acute angle therewith.

Greatest depth u of a blade chamber 4 viewed in the direction of impeller rotation axis x—measured proceeding from opening plane E—can correspond to 0.5 times difference dimension c between second radius dimension $r_2$ and first radius dimension $r_1$.

Figure 7:
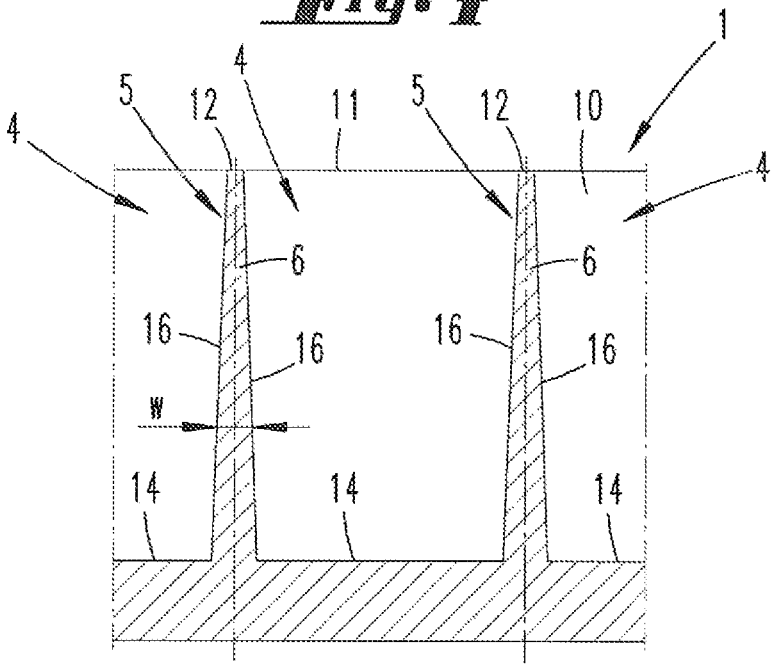
FIG. 7 shows the cross-section according to line VII-VII in FIG. 6.

With reference to a cross-section through blade wall 6 according to the representation in FIG. 7, it can be seen that blade wall 6 is enlarged with regard to wall thickness w proceeding from opening plane E and therefore from terminating edge 12 proceeding in the direction of chamber floor 14. Thus, in the transition to chamber floor 14, a wall thickness w is indicated which roughly corresponds to 3 times thickness w in the region of terminating edge 12.

With respect to a straight line passing centrally through terminating edge 12 in cross-section and running parallel to impeller rotation axis x, blade wall edges 16, especially in the region of radius line $r_4$, form equal acute angles with respect to the straight line.

Figure 8:
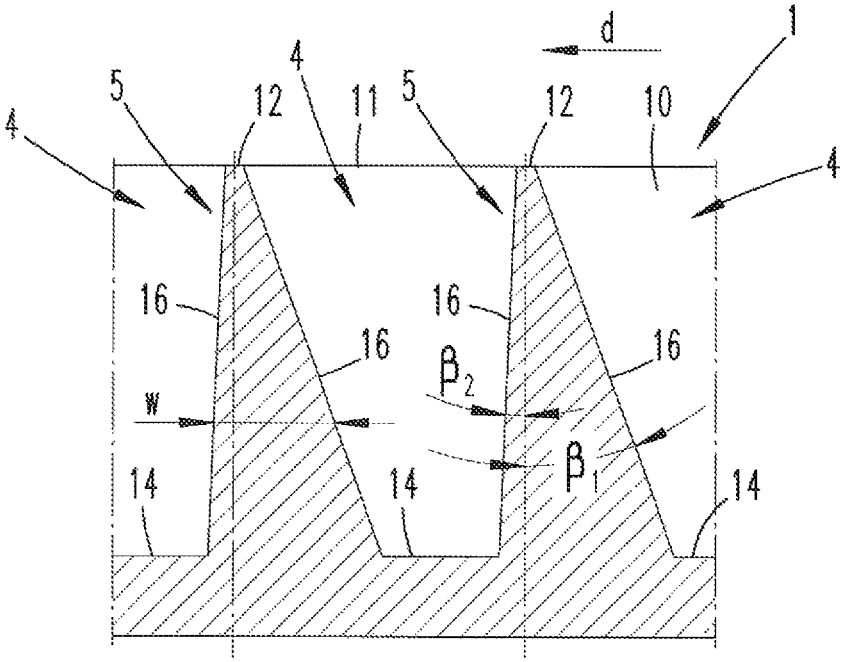
FIG. 8 shows a cross-sectional representation according to FIG. 7, but relating to a further embodiment of the blade wall.

FIG. 8 shows an alternative embodiment.

Here, related to a cross-section through blade wall 6 between the inner run-in point and the outer end, for example the midpoint between first radius dimension $r_1$ and second radius dimension $r_2$, blade wall edges 16 form different acute angles with respect to the straight line. Thus, blade wall edge 16 pointing against direction of rotation d forms an acute angle $\beta_1$ of for example 15 to 30, in particular approx. 20° with respect to the straight line, whilst blade wall edge 16 pointing in direction of rotation d forms an acute angle $\beta_2$ with respect to the straight line of for example 2 to 5°.

Figure 10:
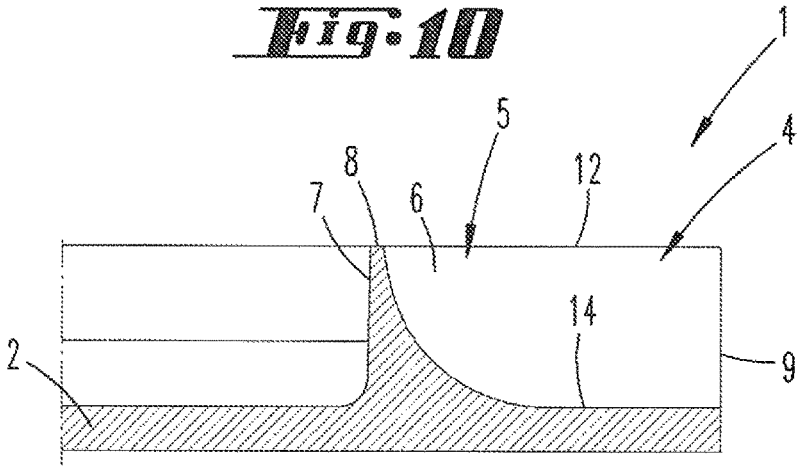
FIG. 10 shows a further representation corresponding to FIG. 6 in a further embodiment.

According to the representation in FIG. 10, blade chambers 4 can also be constituted open radially outwards. Blade wall 6 ending radially exposed at the outside extends radially on the outside in the direction of impeller rotation axis d and defines the size of second radius dimension $r_2$.

The above comments serve to explain the inventions covered as a whole by the application, said inventions each independently developing the prior art at least by the following combinations of features, namely:

An impeller, which is characterised in that greatest offset dimension z corresponds to 0.1 times or more the difference between second $r_2$ and first radius dimension $r_1$.

An impeller, which is characterised in that the greatest offset dimension corresponds to 0.1 to 0.6 times difference c between second $r_2$ and first radius dimension $r_1$.

An impeller, which is characterised in that terminating edge 12 of a blade wall 6 also extends radially on the outside in the direction of impeller rotation axis x and defines the size of second radius dimension $r_2$.

An impeller, which is characterised in that blade wall 6 transforms radially on the outside into a circumferential terminating wall 10 and that an outer edge of terminating wall 10 defines second radius $r_2$.

An impeller, which is characterised in that connecting line V in the extension in the direction of geometrical impeller rotation axis x runs with a perpendicular spacing dimension b with respect to geometrical impeller rotation axis x.

An impeller, which is characterised in that perpendicular spacing dimension b of connecting line V with respect to geometrical impeller rotation axis x lies in the range from −40% to +40 of outer radius dimension $r_2$.

An impeller, which is characterised in that the radially outer end of terminating edge 12, optionally a tangent T passing through the point of intersection of terminating edge 12 and terminating wall 10, forms with connecting line V an acute angle $\alpha$ of up to 90°.

An impeller, which is characterised in that terminating edge 12 at least partially comprises straight segments 13.

An impeller, which is characterised in that terminating edge 12 runs continuously curved between the first $r_1$ and second radius dimension $r_2$.

An impeller, which is characterised in that terminating edge 12 essentially follows a radius line.

An impeller, which is characterised in that a radius $r_3$ of terminating edge 12 is measured from a circle centre-point P, which lies in a blade chamber 4 following in the circumferential direction.

An impeller, which is characterised in that blade wall 6 is enlarged with respect to a wall thickness w proceeding from terminating edge 12 in the direction of geometrical impeller rotation axis x.

An impeller, which is characterised in that the increase in wall thickness w is different related to the circumferential direction.

An impeller, which is characterised in that, related to a cross-section through blade wall 6 between the inner run-in point and the outer end, for example in a midpoint between first radius dimension $r_1$ and second radius dimension $r_2$, blade wall edges 16 form different acute angles β with respect to a straight line running parallel to geometrical impeller rotation axis x.

An impeller, characterised in that acute angle $\beta_1$ of blade wall edge 16 is greater against the direction of rotation than acute angle $\beta_2$ of blade wall edge 16 in the direction of rotation.

An impeller, characterised in that a blade floor 6 runs in a convex manner in direction of rotation d.

An impeller, characterised in that a chamber floor 14 of a blade chamber 4 runs in a circular or elliptical form in a cross-section in connecting line V or parallel thereto, wherein the circular or elliptical line runs at any rate radially on the inside into an upper edge of inner terminating wall 10.

An impeller, which is characterised in that a greatest depth u of a chamber floor 14 corresponds to 0.25 to 0.75 times radius difference c.

Reference List

| | | | |
|---|---|---|---|
| 1 | Impeller | α | Angle |
| 2 | Hub | $\beta_1$ | Angle |
| 3 | Through-hole | $\beta_2$ | Angle |
| 4 | Blade chamber | a | Offset dimension |
| 5 | Blade | b | Spacing |
| 6 | Blade wall | c | Difference dimension |
| 7 | Boundary wall | d | Direction of rotation |
| 8 | Boundary wall edge | $r_1$ | Radius dimension |
| 9 | Circumferential rim edge | $r_2$ | Radius dimension |
| 10 | Terminating wall | $r_3$ | Radius |
| 11 | Terminating wall edge | $r_4$ | Radius line |
| 12 | Terminating edge | u | Depth |
| 13 | Straight segment | w | Wall thickness |
| 14 | Chamber floor | x | Impeller rotation axis |
| 15 | Corner | z | Dimension |
| 16 | Blade wall edge | E | Opening plane |
| | | P | Circle centre-point |
| | | T | Tangent |
| | | V | Connecting line |

The invention claimed is:

1. An impeller comprising blades arranged distributed in the circumferential direction and formed in each case by a blade wall, wherein each blade forms an open blade chamber in a plan view onto the impeller, in which plan view a geometrical impeller rotation axis is depicted in a point-like manner, wherein the blade wall in the plan view starts at a first radius dimension related to the geometrical impeller rotation axis, which first radius dimension corresponds to half or more than half of a second radius dimension, which second radius dimension defines a circumferential rim edge of the impeller, and wherein the first radius dimension defines a radially inner boundary wall of the blade chamber, wherein furthermore a blade wall comprises an exposed upper terminating edge, which runs correspondingly radially on the inside into the inner boundary wall and ends radially on the outside in plan view, wherein an imaginary connecting line can be drawn between a run-in point of the terminating edge into the inner boundary wall and a radially outer end of the terminating edge and the terminating edge runs normal to the connecting line with a different offset dimension, wherein a greatest result of the different offset dimension corresponds to 0.1 times or more the difference between the second and the first radius dimension.

2. The impeller according to claim 1, wherein the greatest result of the different offset dimension corresponds to 0.1 up to 0.6 times the difference between the first and second radius dimension.

3. The impeller according to claim 1, wherein the terminating edge of the blade wall extends radially on the inside in the direction of the impeller rotation axis and defines the size of second radius dimension.

4. The impeller according to claim 1, wherein the blade wall transforms radially at the outside into a circumferential terminating wall and wherein an outer edge of terminating wall defines the second radius.

5. The impeller according to claim 1, wherein the connecting line runs in the extension in the direction of the geometrical impeller rotation axis with a perpendicular spacing dimension with respect to the geometrical impeller rotation axis.

6. The impeller according to claim 5, wherein the perpendicular spatial dimension of the connecting line with respect to the geometrical impeller rotation axis lies in the range from −40% to +40% of the radius dimension.

7. The impeller according to claim 1, wherein the radially outer end of the terminating edge, optionally a tangent passing through the point of intersection of the terminating edge and the terminating wall, forms with the connecting line an acute angle of up to 90°.

8. The impeller according to claim 1, wherein the terminating edge at least partially comprises straight segments.

9. The impeller according to claim 1, wherein the terminating edge runs continuously curved between the first and the second radius dimension.

10. The impeller according to claim 1, wherein the terminating edge essentially follows a radius line.

11. The impeller according to claim 10, wherein a radius of the terminating edge is measured from a circle centerpoint, which lies in the blade chamber following in the circumferential direction.

12. The impeller according to claim 1, wherein the blade wall is enlarged with regard to a wall thickness proceeding from the terminating edge in the direction of the geometrical impeller rotation axis.

13. The impeller according to claim 12, wherein the increase in the wall thickness is different relative to the circumferential direction.

14. The impeller according to claim 1, wherein, relative to a cross-section through the blade wall between the inner run-in point and the outer end, for example in a midpoint between the first radius dimension and the second radius dimension, the blade wall edges form different acute angles with a straight line running parallel to the geometrical impeller rotation axis.

15. The impeller according to claim 14, wherein an acute angle of the blade wall edge is greater against the direction of rotation than an acute angle of the blade wall edge in the direction of rotation.

16. The impeller according to claim 1, wherein the blade wall runs in a convex manner in the direction of rotation.

17. The impeller according to claim 1, wherein a chamber floor of the blade chamber runs in a circular or elliptical form in a cross-section in the connecting line or parallel thereto, wherein the circular or elliptical line runs at any rate radially on the inside into an upper edge of the inner terminating wall.

18. The impeller according to claim 1, wherein a greatest depth of a chamber floor corresponds to 0.25 to 0.75 times the radius difference.

* * * * *